US007584583B2

(12) United States Patent
Bergelin et al.

(10) Patent No.: US 7,584,583 B2
(45) Date of Patent: Sep. 8, 2009

(54) RESILIENT GROOVE

(75) Inventors: Marcus Bergelin, Lerberget (SE); Mats Nilsson, Helsingborg (SE)

(73) Assignee: Valinge Innovation AB, Viken (SE)

( * ) Notice: Subject to any disclaimer, the term of this patent is extended or adjusted under 35 U.S.C. 154(b) by 0 days.

(21) Appl. No.: 11/822,706

(22) Filed: Jul. 9, 2007

(65) Prior Publication Data

US 2008/0000183 A1 Jan. 3, 2008

Related U.S. Application Data

(63) Continuation of application No. 11/649,837, filed on Jan. 5, 2007.

(60) Provisional application No. 60/758,213, filed on Jan. 12, 2006.

(30) Foreign Application Priority Data

Jan. 12, 2006 (SE) ..... 0600055

(51) Int. Cl.
*E04B 5/00* (2006.01)

(52) U.S. Cl. ..... 52/588.1; 52/177

(58) Field of Classification Search ..... 52/177, 52/314, 506.01, 536, 538, 539, 578, 588.1, 52/591.3, 592.1, 403.1, 466, 589.1, 591.1, 52/510, 511, 519, 552; 428/192
See application file for complete search history.

(56) References Cited

U.S. PATENT DOCUMENTS 1,194,636 A 8/1916 Joy
1,723,306 A 8/1929 Sipe
1,743,492 A 1/1930 Sipe
1,787,027 A 12/1930 Wasleff
1,809,393 A 6/1931 Rockwell
1,902,716 A 3/1933 Newton
2,026,511 A 12/1935 Storm
2,266,464 A 12/1941 Kraft
2,430,200 A 11/1947 Wilson
2,596,280 A 5/1952 Nystrom
2,740,167 A 4/1956 Rowley
2,865,058 A 12/1958 Andersson
2,872,712 A * 2/1959 Brown et al. ..... 52/578
2,947,040 A 8/1960 Schultz
3,023,681 A 3/1962 Lee (Continued)

FOREIGN PATENT DOCUMENTS

CA 2456513 A1 2/2003

(Continued)

OTHER PUBLICATIONS

International Search Report issued in PCT/SE2007/000007 (Published as WO 2007/081267 A1), Mar. 21, 2007, Swedish Patent Office, Stockholm, SE.

(Continued)

*Primary Examiner*—Richard E Chilcot, Jr.
*Assistant Examiner*—Bryan Eppes
(74) *Attorney, Agent, or Firm*—Buchanan Ingersoll & Rooney PC

(57) ABSTRACT

A set of moisture proof floorboards and a flooring of such floorboards with a resilient surface layer provided with a decorative groove and/or a sealing means.

13 Claims, 6 Drawing Sheets

U.S. PATENT DOCUMENTS 3,379,958 A 4/1968 Parks
3,517,927 A 6/1970 Kennel
3,526,071 A 9/1970 Watanabe
3,572,224 A 3/1971 Perry
3,579,941 A 5/1971 Tibbals
3,742,669 A 7/1973 Mansfeld
3,849,235 A 11/1974 Gwynne
3,919,820 A 11/1975 Green
4,037,377 A 7/1977 Howell
4,100,710 A 7/1978 Kowallik
4,133,399 A 1/1979 Hansen
4,169,688 A 10/1979 Toshio
RE30,233 E 3/1980 Lane
4,227,430 A 10/1980 Janssen
4,299,070 A 11/1981 Oltmanns
4,426,820 A 1/1984 Terbrack
4,512,131 A 4/1985 Laramore
4,599,841 A 7/1986 Haid
4,648,165 A 3/1987 Whitehorse
4,716,700 A 1/1988 Hagemeyer
4,819,932 A 4/1989 Trotter
5,148,850 A 9/1992 Urbanick
5,247,773 A 9/1993 Weir
5,295,341 A 3/1994 Kajiwara
5,349,796 A 9/1994 Meyerson
5,465,546 A 11/1995 Buse
5,497,589 A 3/1996 Porter
5,502,939 A 4/1996 Zadok
5,577,357 A 11/1996 Civelli
5,587,218 A 12/1996 Betz
5,618,602 A 4/1997 Nelson
5,671,575 A * 9/1997 Wu ..... 52/403.1
5,755,068 A 5/1998 Ormiston
5,860,267 A 1/1999 Pervan
5,899,038 A 5/1999 Stropiana
5,950,389 A 9/1999 Porter
6,029,416 A 2/2000 Andersson
6,052,960 A 4/2000 Yonemura
6,101,778 A 8/2000 Martensson
6,173,548 B1 1/2001 Hamar
6,182,410 B1 2/2001 Pervan
6,203,653 B1 3/2001 Seidner
6,216,409 B1 4/2001 Roy et al.
6,254,301 B1 7/2001 Hatch
6,314,701 B1 11/2001 Meyerson
6,332,733 B1 12/2001 Hamberger
6,345,481 B1 2/2002 Ricciardelli
6,363,677 B1 4/2002 Chen
6,385,936 B1 5/2002 Schneider
6,418,683 B1 7/2002 Martensson
6,438,919 B1 8/2002 Knauseder
6,490,836 B1 12/2002 Moriau
6,505,452 B1 1/2003 Hannig
6,536,178 B1 3/2003 Palsson
6,591,568 B1 7/2003 Palsson
6,601,359 B2 8/2003 Olofsson
6,647,689 B2 11/2003 Pletzer
6,647,690 B1 11/2003 Martensson
6,729,091 B1 5/2004 Martensson
6,763,643 B1 7/2004 Martensson
6,766,622 B1 * 7/2004 Thiers ..... 52/591.3
6,769,219 B2 8/2004 Schwitte et al.
6,786,019 B2 9/2004 Thiers
6,802,166 B1 10/2004 Gerhard
6,854,235 B2 2/2005 Martensson
7,040,068 B2 5/2006 Moriau
7,047,697 B1 5/2006 Heath
7,051,486 B2 5/2006 Pervan
7,137,229 B2 11/2006 Pervan
7,275,350 B2 10/2007 Pervan
7,377,081 B2 5/2008 Ruhdorfer
2002/0100231 A1 * 8/2002 Miller et al. ..... 52/177
2002/0178674 A1 12/2002 Pervan
2003/0024199 A1 2/2003 Pervan et al.
2003/0037504 A1 2/2003 Schwitte et al.
2003/0084636 A1 5/2003 Pervan
2003/0180091 A1 9/2003 Stridsman
2003/0188504 A1 10/2003 Ralf
2003/0196405 A1 10/2003 Pervan
2004/0031227 A1 2/2004 Knauseder
2004/0060255 A1 4/2004 Knauseder
2004/0068954 A1 4/2004 Martensson
2004/0168392 A1 9/2004 Konzelmann
2004/0177584 A1 9/2004 Pervan
2004/0182033 A1 9/2004 Wernersson
2004/0182036 A1 9/2004 Sjoberg
2004/0200175 A1 10/2004 Weber
2004/0211143 A1 10/2004 Hannig
2004/0255541 A1 12/2004 Thiers
2005/0160694 A1 7/2005 Pervan
2005/0166514 A1 8/2005 Pervan
2005/0210810 A1 9/2005 Pervan
2005/0235593 A1 10/2005 Hecht
2005/0252130 A1 11/2005 Martensson
2006/0032168 A1 2/2006 Thiers
2006/0048474 A1 3/2006 Pervan et al.
2006/0070333 A1 4/2006 Pervan
2006/0101769 A1 5/2006 Pervan
2006/0144004 A1 7/2006 Nollet
2006/0236642 A1 10/2006 Pervan
2006/0260254 A1 11/2006 Pervan
2007/0006543 A1 1/2007 Engstrom
2007/0028547 A1 2/2007 Grafenauer
2007/0151189 A1 7/2007 Yang
2007/0175144 A1 8/2007 Hakansson
2007/0175148 A1 8/2007 Bergelin et al.
2007/0193178 A1 8/2007 Groeke et al.
2008/0000179 A1 1/2008 Pervan et al.
2008/0000185 A1 1/2008 Duernberger
2008/0000186 A1 1/2008 Pervan et al.
2008/0000190 A1 1/2008 Hakansson
2008/0010931 A1 1/2008 Pervan et al.
2008/0010937 A1 1/2008 Pervan et al.
2008/0034708 A1 2/2008 Pervan
2008/0041008 A1 2/2008 Pervan
2008/0066415 A1 3/2008 Pervan
2008/0104921 A1 5/2008 Pervan et al.
2008/0110125 A1 5/2008 Pervan
2008/0134607 A1 6/2008 Pervan et al.
2008/0134613 A1 6/2008 Pervan
2008/0134614 A1 6/2008 Pervan et al.
2008/0155930 A1 7/2008 Pervan et al.
2008/0172971 A1 7/2008 Pervan
2008/0216434 A1 9/2008 Pervan
2008/0216920 A1 9/2008 Pervan
2008/0256890 A1 10/2008 Pervan et al.

FOREIGN PATENT DOCUMENTS

CH 690 242 A5 6/2000
DE 2 159 042 6/1973
DE 33 43 601 A1 6/1985
DE 42 15 273 A1 11/1993
DE 42 42 530 A1 6/1994
DE 196 01 322 A1 5/1997
DE 200 02 744 U1 9/2000
DE 100 01 248 A1 7/2001
DE 202 05 774 U1 8/2002
DE 202 06 460 U1 8/2002
DE 102 32 508 C1 12/2003
DE 203 20 799 U1 5/2005
EP 0 665 347 A1 8/1995
EP 0 903 451 A2 3/1999
EP 0 974 713 A1 1/2000

| | | | | |
|---|---|---|---|---|
| EP | 1 045 083 | B1 | | 10/2000 |
| EP | 1 048 423 | A2 | | 11/2000 |
| EP | 1 120 515 | A1 | | 8/2001 |
| EP | 1 146 182 | A2 | | 10/2001 |
| EP | 1 262 609 | A1 | | 12/2002 |
| EP | 1 308 577 | A2 | | 5/2003 |
| EP | 1 357 239 | A2 | | 10/2003 |
| EP | 1 357 239 | A3 | | 10/2003 |
| EP | 1 650 375 | | | 4/2006 |
| FR | 2 810 060 | A1 | | 12/2001 |
| GB | 240 629 | | | 10/1925 |
| GB | 1 171 337 | | | 11/1969 |
| GB | 2 227 813 | A | | 8/1990 |
| GB | 2 256 023 | A | | 11/1992 |
| JP | 05-018028 | A | | 1/1993 |
| JP | 6-146553 | A | | 5/1994 |
| JP | 6-280376 | A | | 10/1994 |
| JP | 8-109734 | A | | 4/1996 |
| JP | 9-088315 | A | | 3/1997 |
| JP | 10-219975 | A | | 8/1998 |
| JP | 2000-226932 | A | | 8/2000 |
| KR | 2007000322 | A | * | 1/2007 |
| SE | 529 079 | C2 | | 4/2007 |
| WO | WO 94/01628 | A1 | | 1/1994 |
| WO | WO 94/26999 | A1 | | 11/1994 |
| WO | WO 96/27721 | A1 | | 9/1996 |
| WO | WO 97/19232 | A1 | | 5/1997 |
| WO | WO 97/47834 | A1 | | 12/1997 |
| WO | WO 98/38401 | A1 | | 9/1998 |
| WO | WO 99/66151 | A1 | | 12/1999 |
| WO | WO 99/66152 | A1 | | 12/1999 |
| WO | WO 00/20705 | A1 | | 4/2000 |
| WO | WO 00/20706 | A1 | | 4/2000 |
| WO | WO 00/47841 | A1 | | 8/2000 |
| WO | WO 01/02669 | A1 | | 1/2001 |
| WO | WO 01/02672 | A1 | | 1/2001 |
| WO | WO 01/07729 | A1 | | 2/2001 |
| WO | WO 01/66877 | A1 | | 9/2001 |
| WO | WO 01/98604 | A1 | | 12/2001 |
| WO | WO 02/055809 | A1 | | 7/2002 |
| WO | WO 02/055810 | A1 | | 7/2002 |
| WO | WO 02/060691 | A1 | | 8/2002 |
| WO | WO 03/012224 | A1 | | 2/2003 |
| WO | WO 03/016654 | A1 | | 2/2003 |
| WO | WO 03/025307 | A1 | | 3/2003 |
| WO | WO 03/078761 | A1 | | 9/2003 |
| WO | WO 03/083234 | A1 | | 10/2003 |
| WO | WO 03/087497 | A1 | | 10/2003 |
| WO | WO 03/089736 | A1 | | 10/2003 |
| WO | WO 2004/020764 | A1 | | 3/2004 |
| WO | WO 2004/053257 | A1 | | 6/2004 |
| WO | WO 2004/079130 | A1 | | 9/2004 |
| WO | WO 2004/083557 | A1 | | 9/2004 |
| WO | WO 2004/085765 | A1 | | 10/2004 |
| WO | WO 2005/054599 | A1 | | 6/2005 |
| WO | WO 2005/068747 | A1 | | 7/2005 |
| WO | WO 2006/043893 | A1 | | 4/2006 |
| WO | WO 2006/050928 | A1 | | 5/2006 |
| WO | WO 2006/104436 | A1 | | 10/2006 |
| WO | WO 2007/015669 | A2 | | 2/2007 |
| WO | WO 2007/015669 | A3 | | 2/2007 |
| WO | WO 2007/089186 | A1 | | 8/2007 |
| WO | WO 2008/017281 | A1 | | 2/2008 |
| WO | WO 2008/017301 | A9 | | 2/2008 |

OTHER PUBLICATIONS

International Preliminary Report on Patentability issued in PCT/SE2007/000007 (Published as WO 2007/081267 A1), Mar. 14, 2008, IPEA/SE—Patent-och registreringsverket, Stockholm, SE.

Written Opinion issued in PCT/SE2007/000007 (Published as WO 2007/081267 A1), Mar. 21, 2007, ISA/SE Patent-och registreringsverket, Stockholm, SE.

U.S. Appl. No. 12/216,892, Pervan, et al.

U.S. Appl. No. 12/362,977, Pervan, et al.

Pervan, et al., U.S. Appl. No. 12/216,892, entitled "Mechanical Locking of Floor Panels With a Flexible Tongue," Jul. 11, 2008.

Boo, et al., U.S. Appl. No. 12/362,977, entitled "Mechanical Locking of Floor Panels," Jan. 30, 2009.

* cited by examiner

RESILIENT GROOVE

CROSS-REFERENCE TO RELATED APPLICATIONS

The present application is a continuation of and claims priority under 35 U.S.C. § 120 to U.S. application Ser. No. 11/649,837, filed Jan. 5, 2007, pending, which claims the benefit of U.S. Provisional Application No. 60/758,213, filed in the United States on Jan. 12, 2006, the entire contents of which are hereby incorporated herein by reference.

AREA OF INVENTION

Embodiments of the present invention relate to a set of moisture proof floorboards and flooring with a resilient surface layer comprising a decorative groove and/or a sealing means.

BACKGROUND OF INVENTION

Embodiments of the invention may concern a floorboard comprising a mechanical locking system, formed at least at two opposite edges and a resilient surface layer provided with a decorative groove. The following description of known techniques, problems of known systems and objects and features of embodiments of the invention will above all, as a non-restrictive example, be aimed as the field of the application. It should be emphasized that embodiments of the invention may be used in any floorboard and it could be combined with all types of known locking systems, for example, where the floorboards are intended to be joined using a mechanical locking system connecting the panels in the horizontal and vertical directions on at least two adjacent sides.

It is known that a floorboard with a resilient surface layer can be provided with a decorative joint portion, in the form of a bevel, for example as described in WO 03/012224.

OBJECTS AND SUMMARY

The floorboards with a resilient surface layer with a decorative joint portion known up to now have several disadvantages. It is only possible to provide the edge with a bevel, which is smaller than the thickness of the resilient surface layer. If the bevel is made larger, the bevel extends down to the moisture sensitive core. The resilient layer is normally thin, and therefore it is only possible to produce small bevels, which are barely visible. Another disadvantage is that both joined and adjacent edges of two floorboards have to be provided with the bevel, in order to look attractive and to increase the total width of the decorative joint portion. Known joints between two floorboards with a resilient surface layer also have the problem of penetration of moisture into the joint, which destroys the moisture sensitive core or sub-floor. The problem increases if the floorboards at the joint are provided with bevels, due to accumulating of dirt and moisture at the bottom of the V-shaped grove, formed by the two adjacent bevels, and a remaining thin barrier part of resilient material.

Embodiments of the present invention relate to a moisture proof flooring and a set of moisture proof floorboards with a resilient surface layer comprising a decorative groove, which provides for embodiments offering advantages. A useful area for the floorboards are public flooring, e.g., in stores, restaurants, ships, hotels, airports, or at home in rooms which are heavily exposed to dirt and therefore often cleaned by mopping. Another useful area is wet-rooms. "Moisture proof floorboard" means that the front face of the floorboard is provided with a moisture proof material and that connecting means and edges of the floorboard are configured to obtain a joint between the floorboard and another adjacent floorboard which is moisture proof.

According to a first aspect, embodiments of the invention provide a set of moisture proof floorboards, comprising a front face, a rear face, a core, connecting means arranged at least at two opposite edges for connecting the floorboard with a similar floorboard, a resilient surface layer at the front face, preferably of rubber or plastic. The resilient surface layer comprises a decorative groove at an edge of the floorboard. The bottom of the decorative groove is essentially flat and parallel to the front face.

An advantage of embodiments of the invention is that there is no limitation of the width of the decorative groove. Even a large decorative groove may be watertight and protect the core or the sub-floor. A second advantage is that only half the amount of edges has to be worked, since it is possible to replace two narrow grooves with one wide groove.

Preferably the edge with the decorative groove comprises, in the resilient layer, a sealing means configured to cooperate with another sealing means in the resilient layer at an edge of another adjacent floorboard, to obtain a sealing. In one embodiment, the sealing means comprises a horizontally extending protrusion and the other sealing means comprises a sideways open groove. In the most preferred embodiment one or both of the sealing means are also provided with a sealing agent.

In another preferred embodiment both of the sealing means comprise a sideways open groove provided with a sealing agent.

Preferably, the connecting means comprise a mechanical locking system formed at least at two opposite edges of the floorboard, which facilitates the joining of a similar floorboard. Mechanical locking systems joined by angling are for instance known from WO 94/26999, which is especially advantageous at the long sides of a rectangular floor, and another locking system especially advantageous at the short sides, particularly when combined with an angling locking system like the one described in WO 94/26999, are described in PCT/SE2005/001586, owner Välinge Innovation AB. Other shapes of floorboards are also possible. The above mentioned combination of locking systems makes it possible to join floorpanels by several methods preferably with a single action method, where the long edge is installed with angling and the short edge, which is provided with a flexible tongue, with vertical folding. This combination is also very easy to disassemble. Other mechanical locking systems are also known, and possible to use, including, for example, systems joined by Angling-Angling, Angling-Snapping or Snapping-Snapping. Floor-boards with a mechanical locking system are generally laid floating, i.e. without gluing, on an existing subfloor.

It is also possible to use a tongue and a groove joint, usually combined with gluing or nailing or other fastening means.

According to an embodiment of the first aspect the wood based core may be made of MDF or HDF, preferably of a thickness of 6-9 mm. The thickness of the resilient surface layer is preferably 1-3 mm.

According to an embodiment, the resilient surface layer comprises three layers, a transparent wear layer at the top, a decorative intermediate layer and reinforcement layer closest to the core. It is also possible to print a pattern directly at the rear side of the transparent wear layer or at the top of the reinforcement layer. Preferably, the decorative groove is only in the transparent layer and optionally colored, but it is also possible to extend the groove down to the decorative layer or the reinforcement layer. Different colors of the layers create a visual effect by extending the groove down to other layers and no coloring may be needed. Another embodiment is a resilient layer comprising only a transparent layer and a reinforcement layer of, for example, a colored plastic or a cork layer. An alternative is that the decorative layer is a wood veneer or a cork layer or that the resilient surface layer has two layers, a transparent wear layer and reinforcement layer of, for example, cork.

According to a second aspect, embodiments of the invention provide a set of moisture proof floorboards, comprising a front face a rear face, a core, connecting means arranged at least at two opposite edges for connecting the floorboard with a similar floorboard, a resilient surface layer at the front face, preferably of rubber or plastic. A moisture proof floorboard being provided at an edge and in the resilient layer with a sealing means configured to cooperate with a another sealing means in the resilient layer at an edge of another adjacent floorboard, to obtain a sealing.

Preferably the sealing means comprises a horizontally extending protrusion and the other sealing means comprises a sideways open groove. In the most preferred embodiment one or both of the sealing means are provided with a sealing agent.

In another preferred embodiment both of the sealing means comprise a sideways open groove provided with a sealing agent.

The sealing means and the sealing agent increase the resistance of moisture and water penetration into the joint and the core and the aim is to completely seal the joint.

According to a second object, embodiments of the invention provide for a flooring comprising at least two of the floorboards above in the first object, joined along adjacent edges, preferably mechanically.

In view of the above, an objective of embodiments of the invention is to solve or at least reduce the problems discussed above.

In particular, an objective of embodiments of this invention is to provide a flooring and floorboard comprising a resilient surface layer with a decorative groove in the resilient surface layer, wherein the groove is clearly visible.

Further, the floorboard is moisture proof and preferably shows great acoustic properties.

All references to "a/an/the [element, device, component, means, step, etc]" are to be interpreted openly as referring to at least one instance of said element, device, component, means, step, etc., unless explicitly stated otherwise.

BRIEF DESCRIPTION OF DRAWINGS

FIGS. 5*a* and 5*c*-6*c* show joined floorboards according to embodiments of the second aspect of the invention.

DETAILED DESCRIPTION OF EMBODIMENTS

As represented in FIGS. 1*b*-4, the first aspect of the invention relates to a set of moisture proof floorboards and flooring, provided with a resilient surface layer with a decorative groove.

Figure 1A:
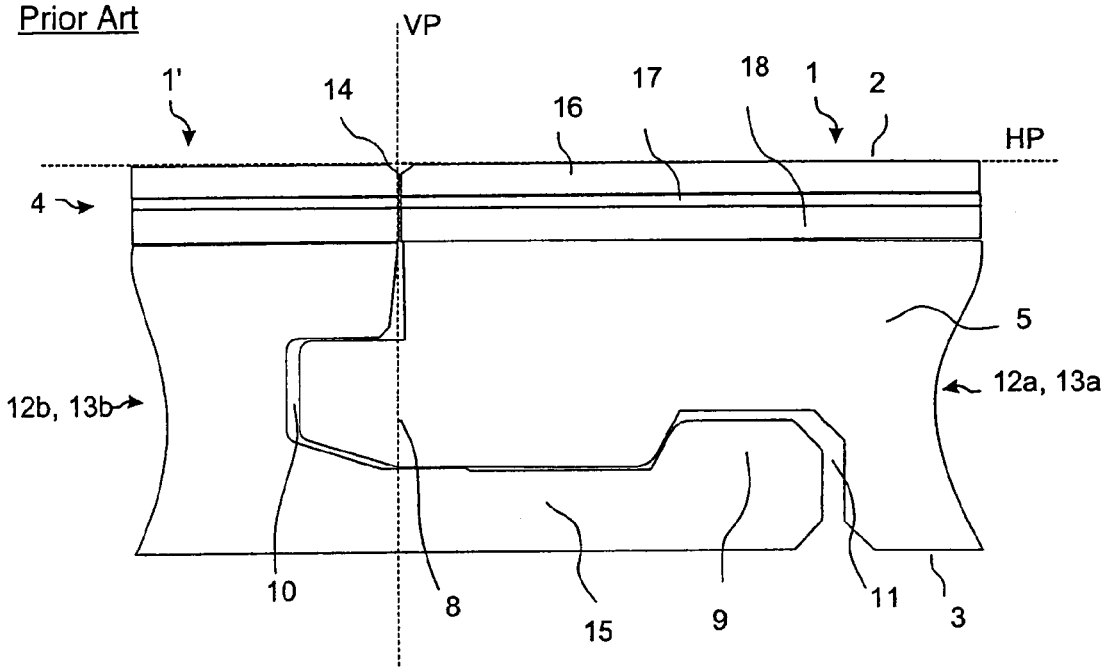
Fig. 1a Prior Art
FIG. 1 a shows a floorboard with a resilient surface layer and decorative groove known in the art.
FIG. 1*b* shows a floorboard according to an embodiment of the invention.
Figure 1B:
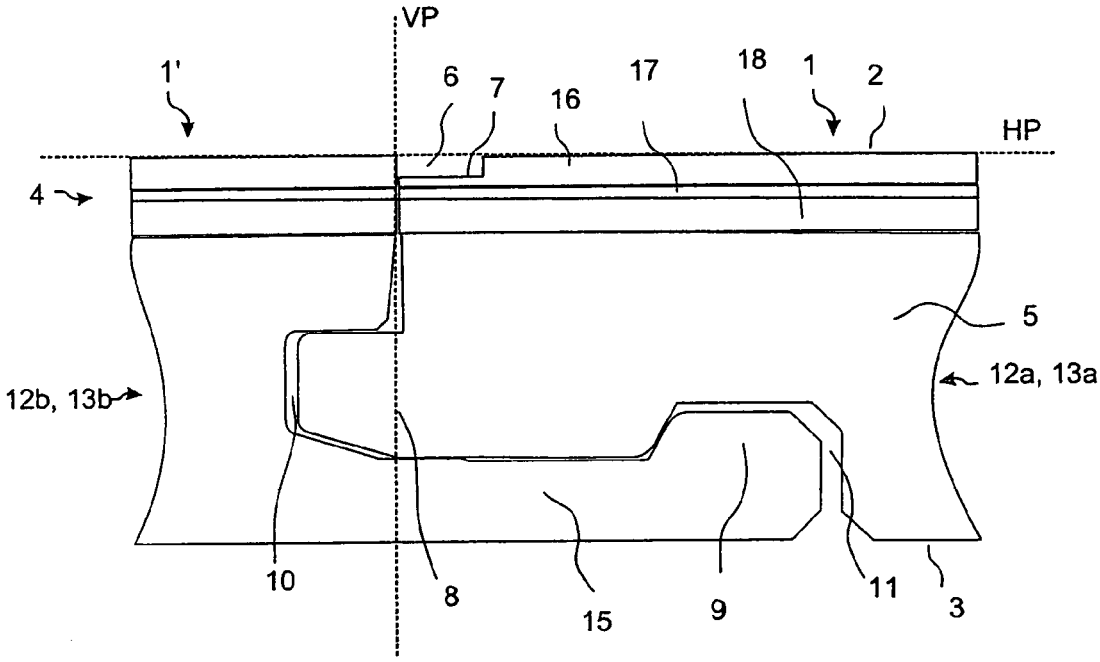

FIG. 1*a* show floorboards with decorative joint portions known in the art and described in WO 03/012224. The floorboard 1 comprises a front face 2 and a rear face 3 extending in the direction of the horizontal plane HP, a wood-based core 5 and a resilient surface layer 4 at the front face. The resilient surface layer 4 comprises three different surface layers having different functions. The upper most layer is a transparent, hard and durable wear layer 16 of plastic material, the intermediate layer is a decorative layer 17 of plastic film and the lowest layer is a reinforcement layer 18 which is made of an elastic material and which can be both moisture-proof and sound-absorbing. The decorative layer 17 of plastic film can be replaced with decorative patterns, which are printed directly on the underside of the transparent wear layer 16 or on the upper side of the elastic reinforcement layer 18. The floorboard is provided with a mechanical locking system for locking the floorboards horizontally and vertically at its long and short edges (12*a*, 13*a*, 12*b*, 13*b*) through angling and/or snapping.

According to a first aspect of the invention, as represented in FIG. 1*b*-4*c*, a floorboard 1 is to be joined with a similar floorboard 1' at adjacent joint edges at a joint plane extending in the vertical plane VP, comprising a front face 2 and a rear face 3 extending in the horizontal plane HP, a core 5, a connecting means arranged at least at two opposite edges for connecting the floorboard with a similar floorboard 1' in a vertical and/or horizontal direction and a resilient surface layer 4, characterized in that at least one edge of the floorboard 1 comprising a decorative groove 6 in the resilient surface layer 4 with a bottom 7 which is essentially parallel to the front face 2. If the floorboard is rectangular, preferably only one of the long edges is provided with the decorative groove; certainly it is also possible to provide one of the long and one of the short edges with the groove 7. Other shapes of the board are also possible, e.g. 3, 5, 6, 7 and 8 edges. The resilient surface layer comprises preferably a transparent wear layer 16 at the top, preferably of a plastic material, an intermediate decorative layer 17 and an elastic reinforcement layer 18 closest to the core 5. The decorative layer 17, preferably of a plastic film can be replaced with decorative patterns, which are printed directly on the underside of the transparent wear layer 16 or on the upper side of the elastic reinforcement layer 18. An alternative is that the decorative layer is a wood veneer or cork layer. According to the embodiment represented in FIG. 1*b*, the groove 7 is only in the transparent layer and optionally the groove is colored.

Preferably the connecting means is a mechanical locking system formed at least at two opposite edges 12*a*, 13*a*, 12*b*, 13*b*. The shown mechanical locking system comprising a locking strip 15 with a locking element 9, a tongue 8 and a tongue groove 10. Other known mechanical locking systems for floorboards are also possible to use such as the tongue lock in FIG. 4*a*-*c* or the flexible tongue described in described in PCT/SE2005/001586. The tongue may also be replaced by a displaceable tongue 8' arranged in a displacement grove 54, as shown in FIG. 5*b* to 6*c*, of the type disclosed in PCT/SE2005/001586 or PCT/SE2006/001218.

There are many alternatives for the number of layers in the resilient layer, the material of the layers and into which layer the groove extends. Some of the alternatives are represented in FIG. 1*b*-2*d*.

Figure 2A:
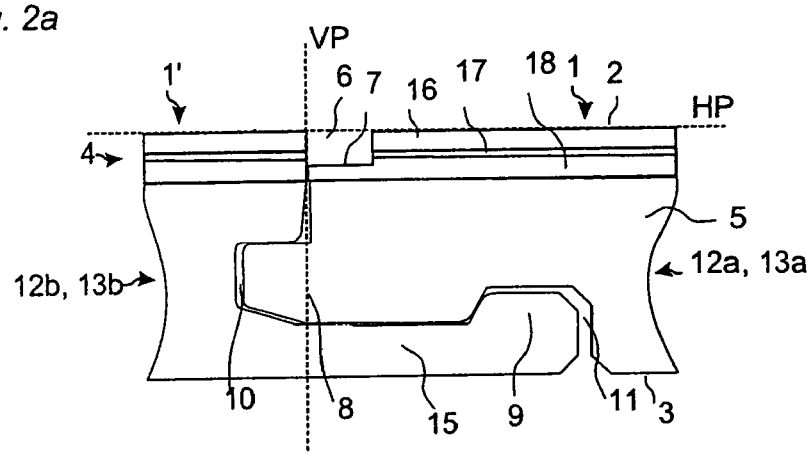
FIGS. 2*a*-*d* show alternative embodiments of the invention.

The resilient surface layer 4, illustrated in FIG. 2*a*, comprising a transparent surface layer 16, an intermediate decorative layer 17 and a reinforcement layer 18 closest to the core. The groove 6 extends down to the reinforcement layer and is preferably colored. If one of the layers in the resilient layer, represented in FIG. 1*b*-bd is of a non water proof or moisture sensitive material, it is preferred that the groove does not extend into this layer.

Figure 2B:
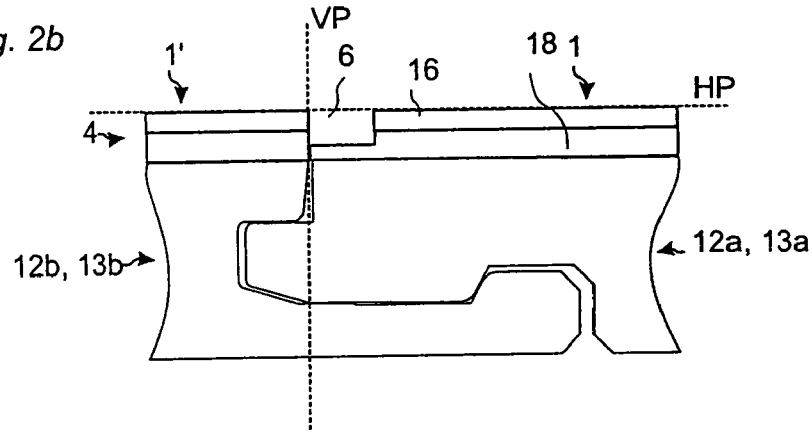

The resilient surface layer 4, illustrated in FIG. 2*b*, is substantially a transparent surface layer 16 and a reinforcement layer closest to the core 18. The groove 6 extends down to the reinforcement layer, preferably of plastic and is preferably colored.

Figure 2C:
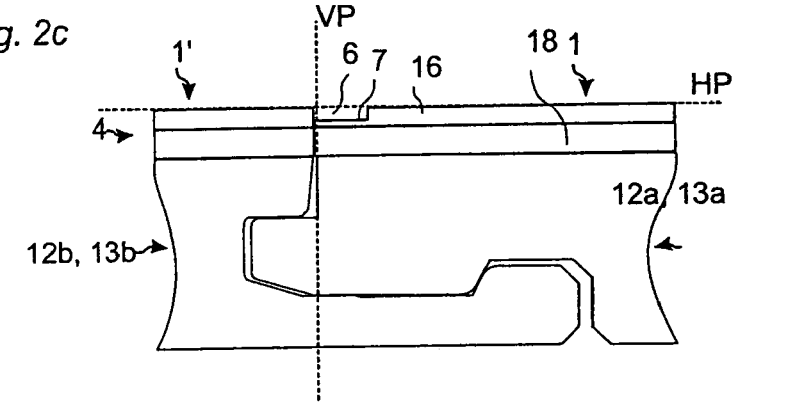

The resilient surface layer 4 illustrated in FIG. 2*c*, is substantially a transparent surface layer 16 and a reinforcement layer closest to the core 18. The groove 6 is only in the transparent layer and is preferably colored. The reinforcement layer is preferably of a colored plastic or a cork layer.

Figure 2D:
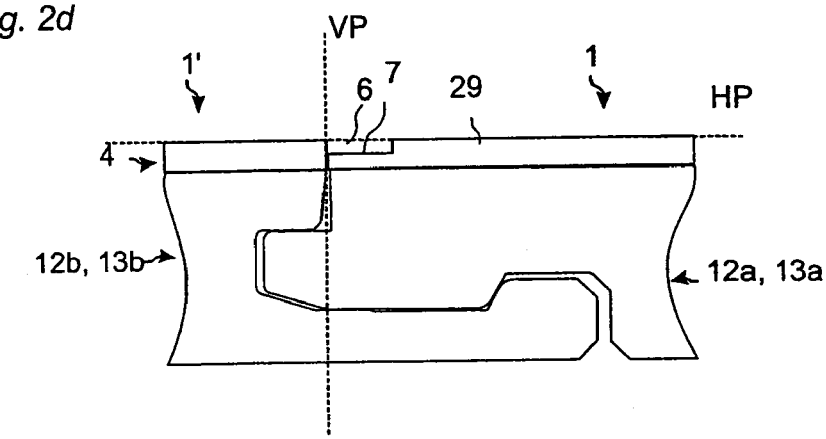

The resilient surface layer 4 in FIG. 2*d*, is substantially only one layer. The groove is preferably colored.

Figure 4A:
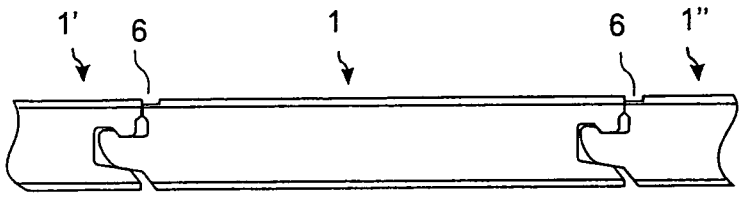
FIGS. 4*a*-*c* show a floorboard and joined floorboards in different views according to an embodiment of the invention.
Figure 4B:
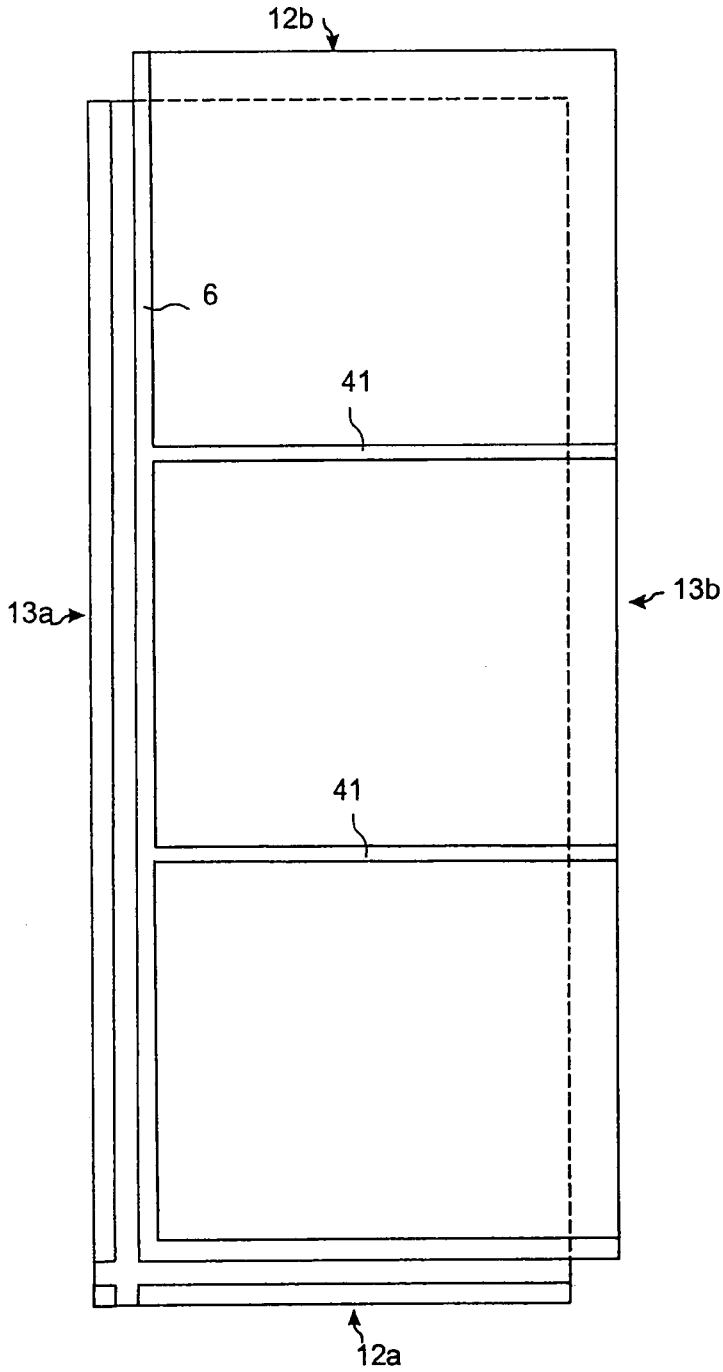
Figure 4C:
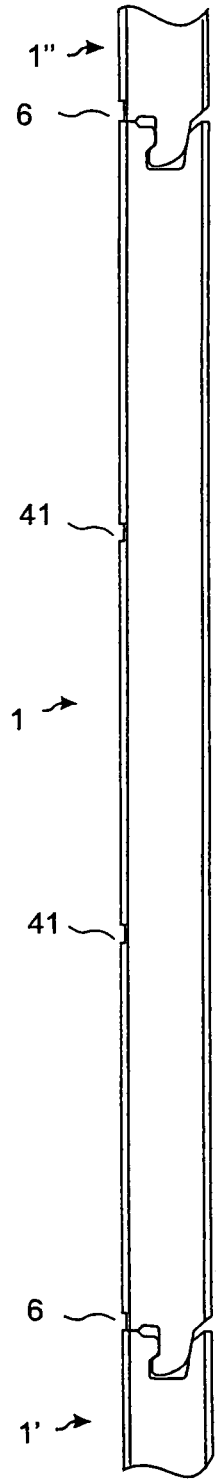

In FIG. 4*b* an embodiment of the invention is represented, comprising a rectangular floorboard 1 with a mechanical locking system at long 13*a*, 13*b* and short edges 12*a*, 12*b* and a decorative groove 6 along only one of the long edges and along only one of the short edges. Additional grooves 41 in the resilient surface layer, between the short edges, are provided. FIG. 4*a* is a cross section of the floorboard in FIG. 6*b*, perpendicular to the long edges, joined to similar floorboards 1' and 1". FIG. 4*c* is a cross section of the floorboard in FIG. 4*b*, perpendicular to the short edges, joined to similar floorboards 1' and 1".

The wood-based core material is preferably a particle, MDF, HDF or plywood board.

As non-limiting example, materials that can be used in a resilient surface layer are acrylic plastic-based materials, elastomers of synthetic rubber, urethane rubber, silicone rubber or the like, polyurethane-based hot-melt adhesive, PVC or polyethylene.

The decorative groove may be made by chemical or mechanical working, preferably cutting or grinding. It is also possible to color the groove. If grinding is used it is possible to make a very shallow groove or even just change the roughness and the brightness of the surface. The grinding method is applicable also to a laminate flooring with a surface layer of resin-impregnated sheets. Another technique is to cut off a part of the resilient surface layer, or cut it to the desirable shape before attaching it to the core, and replace it with another resilient layer of different color or structure.

A second aspect of the invention, as illustrated in FIG. 5*a*-6*c*, is a set of essentially identical moisture proof floorboards 1 each comprising a sealing means at an edge. Each floorboard comprises a front face and a rear face extending in the horizontal plane HP, a core, a connecting means 8, 9, 10, 11, 15, 8', 54 arranged at least at two opposite edges for connecting a floorboard with a another floorboard 1' in a vertical and/or horizontal direction and a resilient surface layer 4. A moisture proof floorboard comprising, at an edge and in the resilient layer 4, a sealing means 51 configured to cooperate with another sealing means 52 in the resilient layer at an edge of another adjacent floorboard, to obtain a sealing.

Figure 5A:
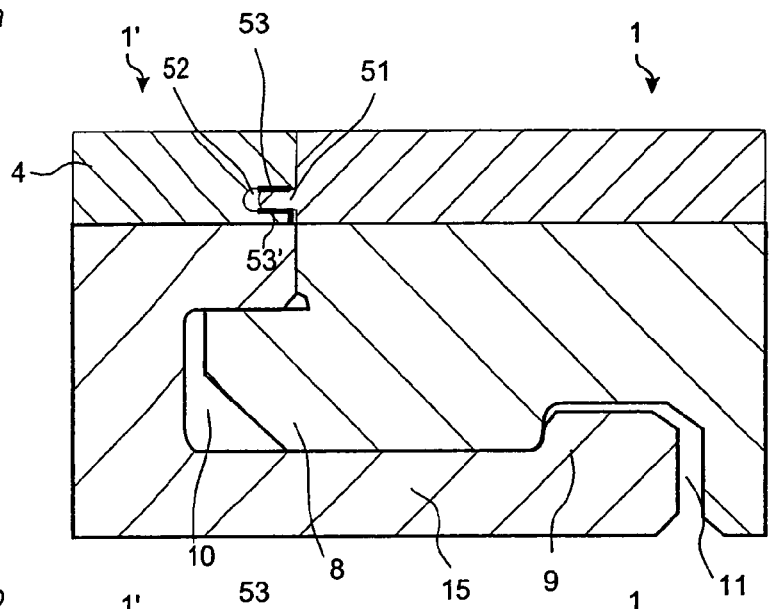
Figure 5B:
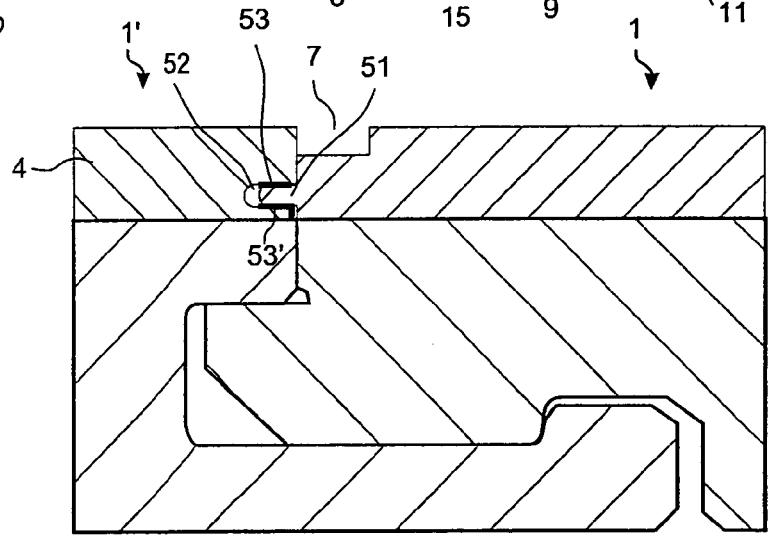
FIG. 5*b* shows an embodiment of a floorboard, according to the first aspect provided with a sealing means according to the second aspect.

The sealing means may comprise a horizontally extending protrusion and the other sealing means may comprise a sideways open groove, as shown in FIG. 5*a*. In the most preferred embodiment one or both of the sealing means are provided with a sealing agent 53.

Figure 6A:
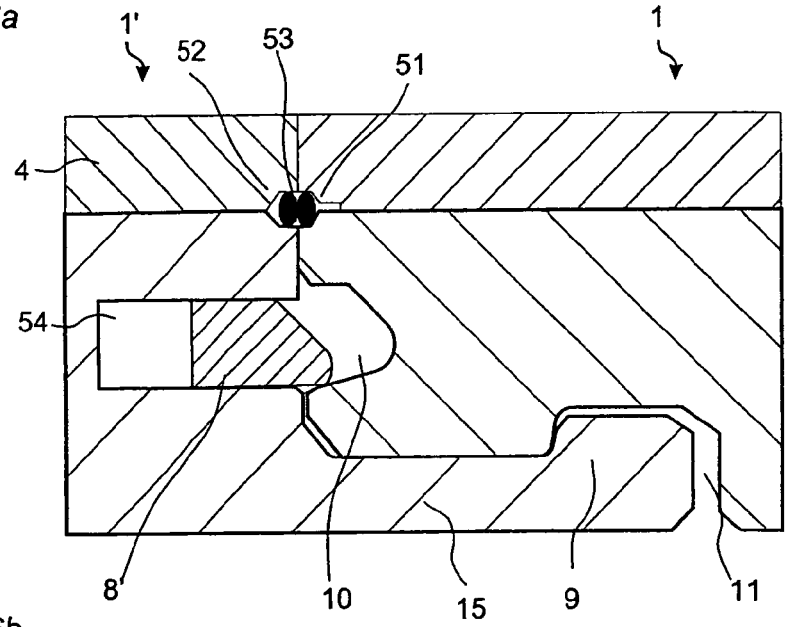

In another embodiment, shown in FIG. 6*a*, both the sealing means 51, 52 comprise a sideways open groove provided with a sealing agent 53.

Figure 5C:
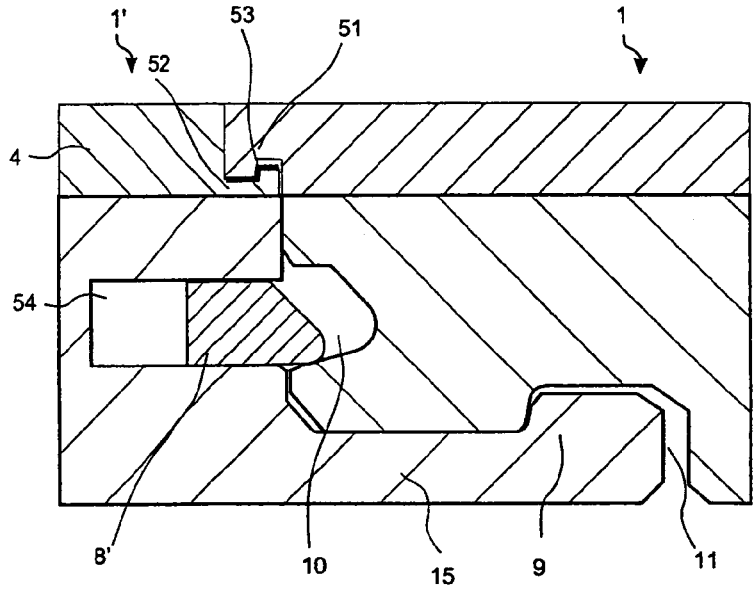

In FIG. 5*c* an embodiment of the sealing means is illustrated comprising overlapping edges, preferably provided with a hook shaped connection 51, 52. A sealing agent 53 may also be provided.

The sealing agent may comprise wax, grease, oil or bitumen. A preferred sealing agent comprises a mix of paraffin wax and paraffin oil. Another example is a micro wax and a natural or synthetic rubber strip.

Figure 6B:
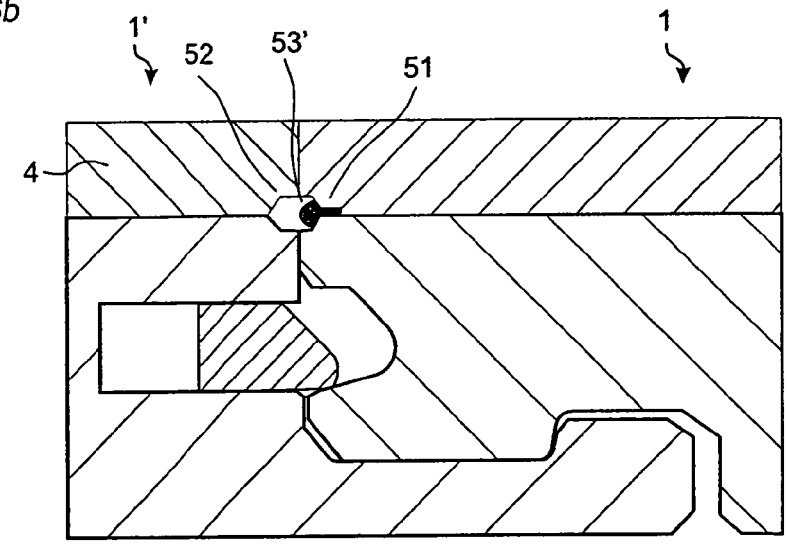
Figure 6C:
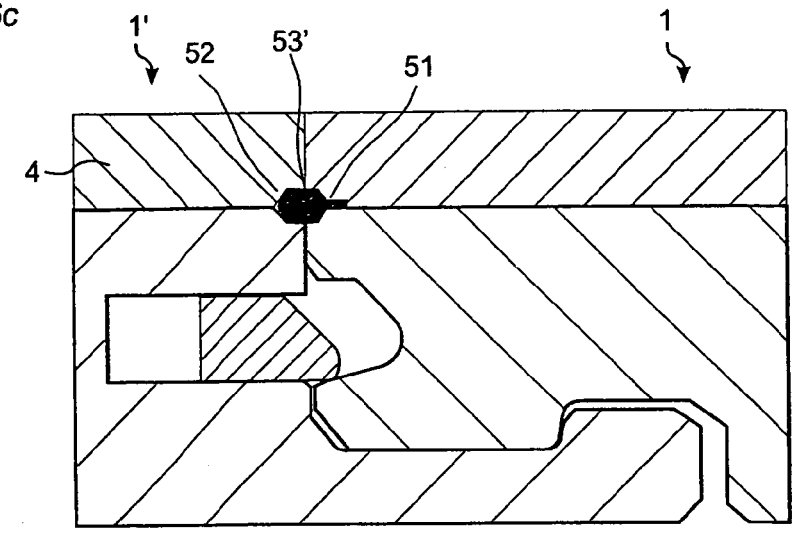

In FIG. 6*b* an embodiment of the sealing means is illustrated comprising an expandable sealing agent 53', arranged at a sideways open groove 51 in the resilient layer 4. The sealing agent is configured to expand into a sideways open groove 52 in the resilient layer of an adjacent floor panel, as illustrated in FIG. 6*c*, after that the two panels are connected to each other by the connecting means. An example of an expandable sealing agent 53' is a strip, preferably of polyurethane, provided with tape, which is removed just before the connection of the two adjacent floorboards. Other examples are materials, which expand when exposed to moisture.

The first aspect of the invention, comprising a decorative groove 7, may be combined with the second aspect, comprising sealing means 51, 52, as illustrated in 5*b*.

Figure 3:
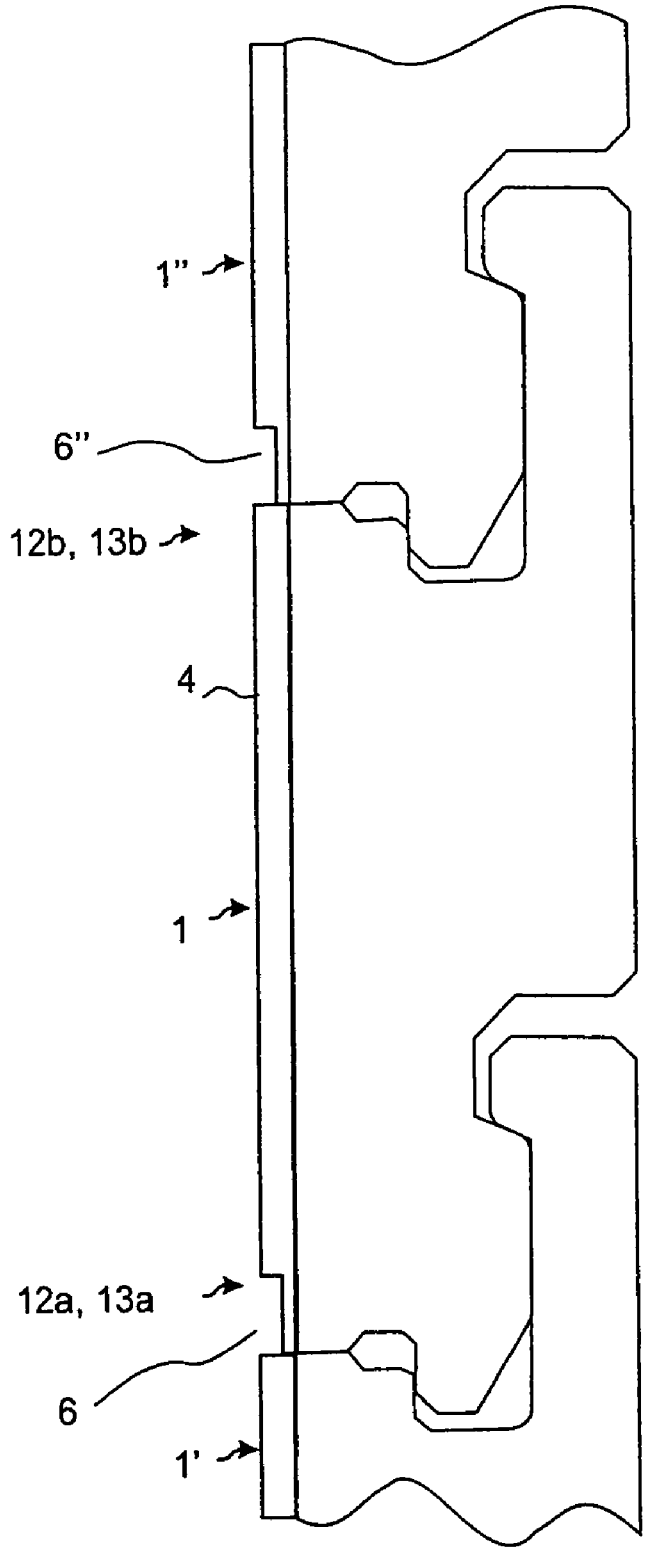
FIG. 3 shows three joined floorboards according to an embodiment of the invention.

A second object of the invention, represented by FIGS. 3 and 4, is a flooring comprising a set of the floorboards 1, 1', according to the first and/or second aspect, joined along adjacent edges, preferably mechanically.

In the most preferred embodiment, only one of the edges 12*a*, 13*a*, 12*b*, 13*b* of the two joined and adjacent edges is provided with the decorative groove.

Embodiments of the invention have mainly been described above with reference to a few embodiments. However, as is readily appreciated by a person skilled in the art, other embodiments than the ones disclosed above are equally possible within the scope of the invention, as defined by the appended patent claims.

Generally, all terms used in the claims are to be interpreted according to their ordinary meaning in the technical field, unless explicitly defined otherwise herein.

The invention claimed is:

1. A set of essentially identical moisture proof floorboards each comprising a front face and a rear face extending in the horizontal plane, a core, a connecting device arranged at least at two opposite edges for connecting a floorboard with another floorboard in a horizontal direction and a resilient surface layer defining the front face, the moisture proof floorboard being provided, at an edge and completely within the resilient surface layer, with a sealing device configured to cooperate with another sealing device in the resilient surface layer at an edge of another adjacent floorboard, to obtain a sealing, wherein one of the sealing devices is a vertically extending protrusion and the other sealing device is a vertically open groove, wherein the core includes the connecting device, and wherein at least a portion of the edge of the resilient surface layer including the sealing device and at least a portion of the edge of the core including the connecting device are in the same vertical plane.

2. The set of essentially identical moisture proof floorboards as claimed in claim 1, wherein one or both of the sealing devices are provided with a sealing agent.

3. The set of essentially identical moisture proof floorboards as claimed in claim 2, wherein the sealing agent comprises paraffin wax or paraffin oil.

4. The set of essentially identical moisture proof floorboards as claimed in claim 2, wherein the sealing agent is expandable.

5. The set of essentially identical moisture proof floorboards as claimed in claim 4, wherein the sealing agent is expandable in contact with water.

6. The set of essentially identical moisture proof floorboards as claimed in claim 1, wherein in the connecting devices are configured for connecting a floorboard with another floorboard in a vertical direction by vertical folding.

7. The set of essentially identical moisture proof floorboards as claimed in claim 6, wherein the connecting devices comprises a displaceable tongue configured to cooperate with a tongue groove for vertical connection.

8. The set of essentially identical moisture proof floorboards as claimed in claim 1, wherein at least one edge of each of the floorboards comprises a decorative groove in the resilient surface layer with a bottom which is essentially parallel to the front face.

9. A moisture proof flooring comprising a set of floorboards in accordance with claim 1, wherein at least two floorboards are mechanically connected together.

10. The moisture proof flooring as claimed in claim 9, wherein at least two floorboards are mechanically connected in the horizontal and vertical direction at adjacent edges.

11. The set of essentially identical moisture proof floorboards as claimed in claim 1, wherein the connecting device comprises a locking system formed in the core.

12. The set of essentially identical moisture proof floorboards as claimed in claim 1, wherein the core has a thickness in a vertical plane, the thickness of the core being greater than a thickness of the resilient surface layer.

13. The set of essentially identical moisture proof floorboards as claimed in claim 1, wherein the sealing device is disposed proximal the front face, and the connecting device is disposed along the edge of the moisture proof floorboard between the sealing device and the rear face.

* * * * *